US009559474B2

(12) United States Patent
Chen

(10) Patent No.: US 9,559,474 B2
(45) Date of Patent: Jan. 31, 2017

(54) TRACK TRANSMISSION SYSTEM AND TRACK TRANSMISSION DEVICE THEREOF

(71) Applicant: AOPEN INC., New Taipei (TW)

(72) Inventor: Yi-Jen Chen, New Taipei (TW)

(73) Assignee: Aopen Inc., New Taipei (TW)

( * ) Notice: Subject to any disclaimer, the term of this patent is extended or adjusted under 35 U.S.C. 154(b) by 272 days.

(21) Appl. No.: 14/180,469

(22) Filed: Feb. 14, 2014

(65) Prior Publication Data

US 2014/0308829 A1 Oct. 16, 2014

(30) Foreign Application Priority Data

Apr. 12, 2013 (TW) ..... 102112979 A

(51) Int. Cl.
*H01R 25/14* (2006.01)
*H01R 24/64* (2011.01)

(52) U.S. Cl.
CPC ..... *H01R 25/145* (2013.01); *H01R 25/142* (2013.01); *H01R 24/64* (2013.01)

(58) Field of Classification Search
CPC ..... H01R 25/145; H01R 25/142
See application file for complete search history.

(56) References Cited

U.S. PATENT DOCUMENTS 4,494,808 A * 1/1985 Widell ..... H01R 25/14 439/119
6,827,592 B2 * 12/2004 McCoy ..... H01R 25/165 439/118
8,616,921 B2 * 12/2013 Byrne ..... H01R 25/00 439/214
8,899,999 B2 * 12/2014 MacKiewicz ..... F21S 8/038 439/118
2002/0072256 A1 * 6/2002 Lostoski ..... H01R 9/26 439/76.1
2005/0170678 A1 * 8/2005 Donahue, IV ..... H01R 13/514 439/214
2006/0234540 A1 * 10/2006 Tipley ..... H01R 12/88 439/260
2009/0021936 A1 * 1/2009 Stimac ..... F21S 2/005 362/249.02

(Continued)

FOREIGN PATENT DOCUMENTS

TW M315421 U 7/2007

OTHER PUBLICATIONS

Communication From the Taiwan Patent Office Regarding a Counterpart Foreign Application Dated (Taiwan Year 104) Oct. 1, 2015.

*Primary Examiner* — Briggitte R Hammond
(74) *Attorney, Agent, or Firm* — Rosenberg, Klein & Lee

(57) ABSTRACT

The present disclosure provides a track transmission system and the track transmission device thereof. The track transmission system comprises at least a track transmission device, a connecting device, and a control device. The track transmission device is provided for disposing slidably at least an electronic device. In addition, signal transmission with the control device can be accomplished through the connecting device. The electronic device is coupled to the circuit board of the track transmission device by contacting. As the electronic device slides along the track transmission device, signal transmission with the control device still can be maintained.

19 Claims, 15 Drawing Sheets

(56) References Cited

U.S. PATENT DOCUMENTS

| | | | | |
|---|---|---|---|---|
| 2009/0219713 | A1* | 9/2009 | Siemiet | F21V 3/02 362/218 |
| 2010/0271834 | A1* | 10/2010 | Muessli | F21V 21/35 362/398 |
| 2011/0285314 | A1* | 11/2011 | Carney | E04B 9/006 315/294 |
| 2012/0120650 | A1* | 5/2012 | Sadeh | F21V 5/04 362/235 |

* cited by examiner

TRACK TRANSMISSION SYSTEM AND TRACK TRANSMISSION DEVICE THEREOF

FIELD OF THE DISCLOSURE

The present disclosure relates generally to a transmission system and the device thereof, and particularly to a track transmission system and the track transmission device thereof capable of transmitting signals.

BACKGROUND OF THE DISCLOSURE

Thanks to the progresses in technologies, flat-panel displays (FPDs) have almost replaced completely cathode ray tube (CRT) displays and become the mainstream in modern display technologies. Compared with the bulky size of traditional CRT displays, FPDs have the advantages of low power consumption, low radiation, and thin outlines. In addition, the expansion in the size of FPDs also popularizes thin digital TVs in consumer and entertainment applications such as home viewing, outdoor advertisements, and exhibition purposes.

Currently, small-sized FPDs have been applied to product exhibition frames mainly for display product prices and product information. By avoiding manually changing the labels of product prices and product information, labor costs can be reduced. At present, each display is loaded with batteries and operates using battery power. Nonetheless, battery power tends to be consumed rapidly, which leads to increases in the consumption of batteries. Besides, labor is required for changing the batteries of displays, resulting in increases in labor costs. Then, each display updates the product prices and product information by connecting to handheld devices or main computers via a wireless module. However, the wireless module disposed in each display increases the cost.

Accordingly, the present disclosure provides a track transmission system and the track transmission device thereof. One or multiple electronic device can receive the external power supply and the signals transmitted by a control device at the remote site by means of the track transmission device. The electronic devices can slide along the track transmission device freely while keeping receiving the power supply and the transmitted signals. In addition, by using the control device, the information displayed on each electronic device can be changed real-timely. Thereby, the electronic device still can transmit signal without wireless modules and thus saving costs.

SUMMARY

An objective of the present disclosure is to provide a track transmission system and the track transmission device thereof. The track transmission device is provided so that at least an electronic device can be disposed slidably thereon. In addition, the track transmission device transmits signals and power with a remote control device for supplying power to the electronic device as well as transmitting signal between the electronic device and the control device.

Another objective of the present disclosure is to provide a track transmission system and the track transmission device thereof. The electronic device is coupled to the track transmission device by contacting and slides along the track transmission device. Besides, the electronic device maintains the contact coupling with the track transmission device for keeping power and signal transmission.

Still another objective of the present disclosure is to provide a track transmission system and the track transmission device thereof. The electronic device disposed on the track transmission device needs no wireless module. Hence, the manufacturing cost of the electronic device is reduced.

For achieving the objectives and effects described above, the present disclosure discloses a track transmission device, which comprises a track, a circuit board, a first electrical connector, and a second electrical connector. The track is provided for disposing at least an electronic device; the electronic device slides along the track. The circuit board is disposed on the track and includes a plurality of transmission circuits. The first electrical connector has a plurality of first terminals coupled to the plurality of transmission circuits, respectively. The second electrical connector is connected electrically to the electronic device and including a plurality of second terminals; the plurality of second terminals are coupled to the plurality of transmission circuits for transmitting signals and power to the electronic device.

The present disclosure provides at least a track transmission device, a connecting device, and a control device. An electronic device slides can slide along the track transmission device and is connected electrically to the track transmission device. The connecting device is connected electrically to the plurality of track transmission device. The control device is connected to the connecting device. Signals and power are transmitted between the control device and the track transmission device by means of the connecting device. The track transmission device transmits signals and power to the electronic device.

DETAILED DESCRIPTION

In order to make the structure and characteristics as well as the effectiveness of the present disclosure to be further understood and recognized, the detailed description of the present disclosure is provided as follows along with embodiments and accompanying figures.

The electronic devices according to the prior art such FPDs are gradually applied to displaying product prices and information on product exhibition frames. This kind of electronic devices are operated by battery power. Consequently, the consumption of batteries is increased and the batteries should be replaced manually. In addition, because there are multiple electronic devices on an exhibition frame at the same time, in order to the change the content shown on each electronic tag, the electronic devices should be connected to a control host using wireless modules one by one. This method leads to many inconveniences in application as well as to increases in the manufacturing costs of the electronic devices. Accordingly, the present disclosure provides a track transmission system the track transmission device thereof for improving the problems described above.

Figure 1:
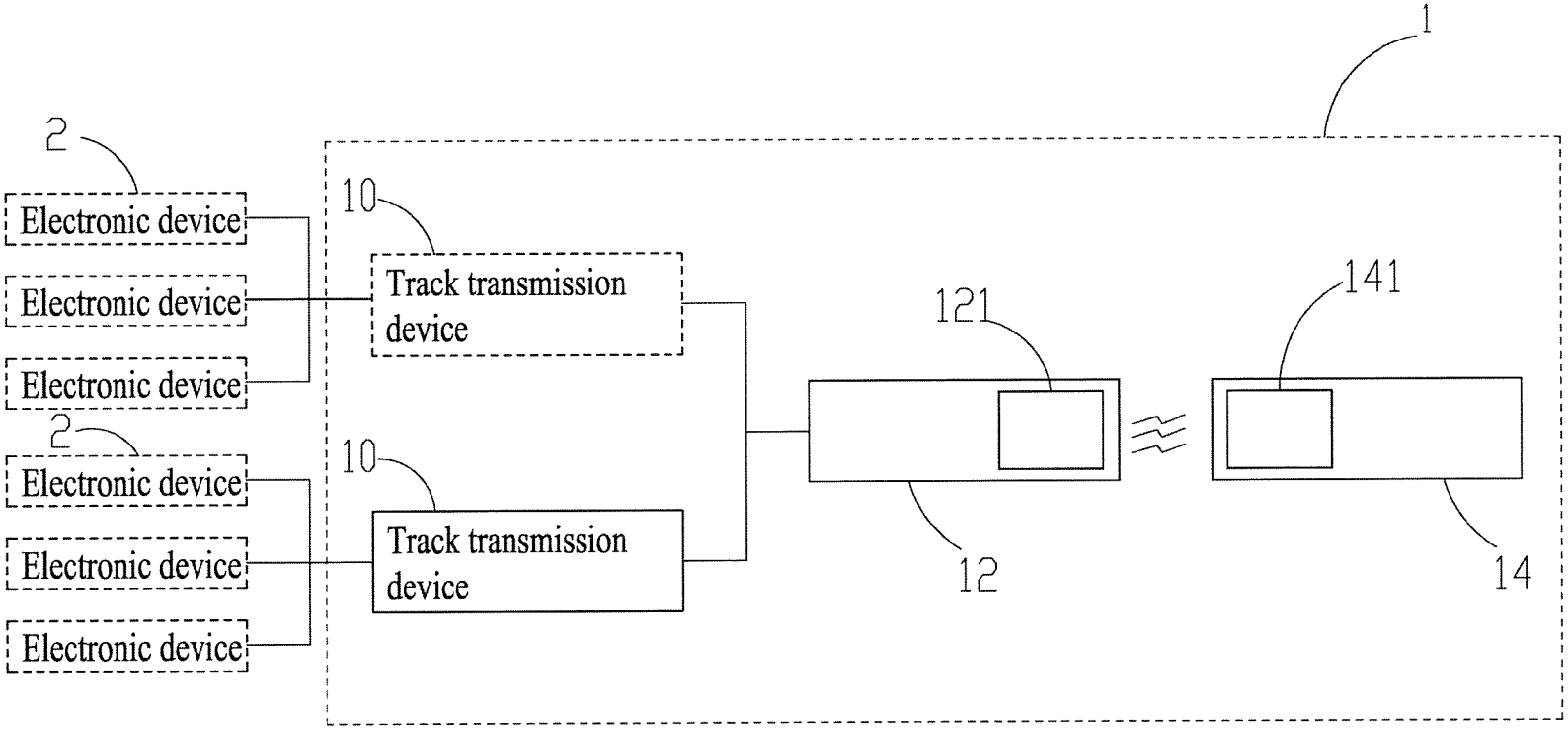
FIG. 1 shows a block diagram of the track transmission system according to the first embodiment of the present disclosure.

FIG. 1 shows a block diagram of the track transmission system according to the first embodiment of the present disclosure. As shown in the figure, the present embodiment provides a track transmission system 1, which comprises at least a track transmission device 10, a connecting device 12, and a control device 14. Each track transmission device 10 is used for carrying at least an electronic device 2. The electronic device 2 slides along the track transmission device 10 and is coupled to the track transmission device 10 through contact. The track transmission device 10 is connected with the control device 14 via the connecting device 12. Thereby, signal transmission between the track transmission device 10 and the control device 14 can be done and thus the control device 14 can control the electronic device 2 of the track transmission device 10 remotely. According to the present embodiment, the connecting device 12 and the track transmission device 10 connected in wires. The track transmission device 10 transmits at least signal generated by the electronic device 2 to the connecting device 12. The connecting device 12 and the control device 14 can be connected in wire or wireless method for transmitting the signal of the electronic device 2 to the control device 14 or transmitting at least a control signal generated by the control device 14 to the track transmission device 10. Then the electronic device 2 receives the control signal through the track transmission device 10.

In the following, the connecting method between the connecting device 12 and the control device 14 will be described. The connecting device 12 has a first transmission unit 121; the control device 14 has a second transmission unit 141. If the connecting device 12 and the control device 14 are connected in wires, namely, the first and second transmission units 121, 141 are connected by a transmission line, the first and second transmission units 121, 141 are connected electrically. Thereby, the connecting device 12 can receive the control signal generated by the control device 14 or transmit the signal generated by the electronic device 2. As the track transmission device 10, the connecting device 12, and the control device 14 are connected in wires, the power of the electronic device 2 can be supplied by the connecting device 12 or the control device 14.

If the connecting device 12 and control device 14 are wirelessly connected, signals are transmitted wirelessly between the first and second transmission units 121, 141. Then the first and second transmission units 121, 141 are a signal transmitter or a signal receiver, respectively. When the first and second transmission units 121, 141 accomplish the communication protocol, they are connected to each other. Consequently, the connecting device 12 receives the control signal generated by the control device 14 or transmits the signal generated by the electronic device 2. At this time, the track transmission device 10 is connected in wires with the connecting device 12 only. Thereby, the power of the electronic device 2 is supplied by the connecting device 12 only. According to the present embodiment, the connecting device 12 and the control device 14 transmit signals therebetween using the wireless method.

Figure 2:
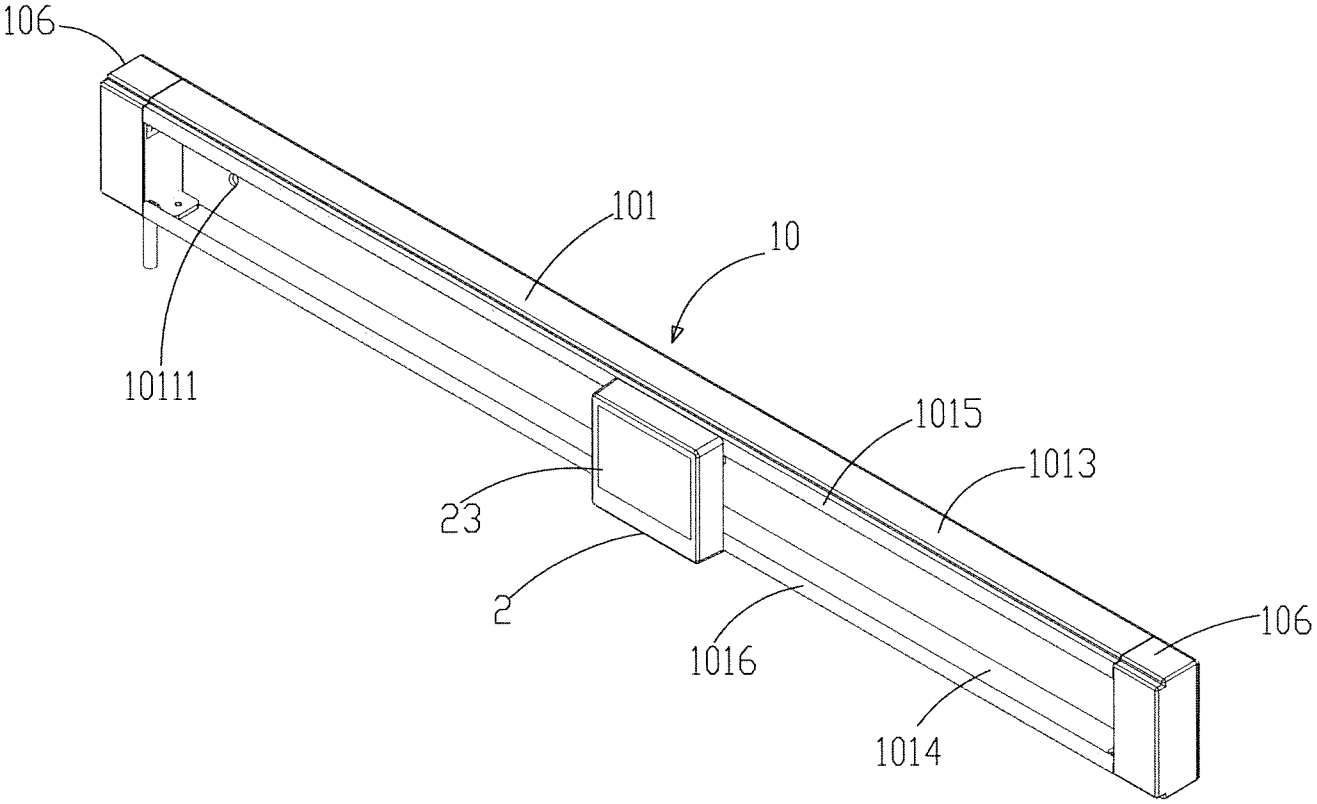
FIG. 2 shows a usage status diagram of the track transmission device according to the first embodiment of the present disclosure.
Figure 3:
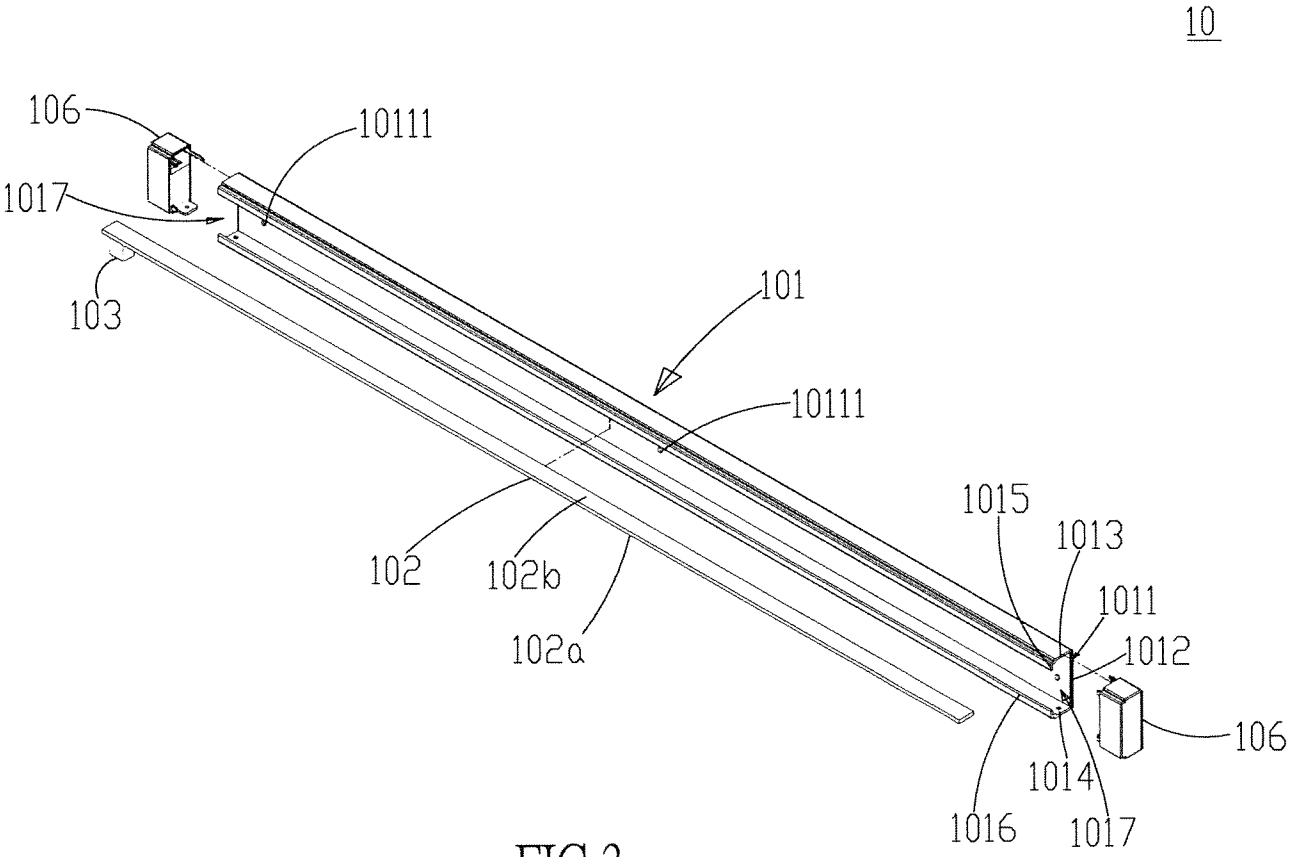
FIG. 3 shows an assembly diagram of the track transmission device according to the first embodiment of the present disclosure.

FIGS. 2 and 3 show a usage status diagram and an assembly diagram of the track transmission device according to the first embodiment of the present disclosure. As shown in the figures, the track transmission device 10 comprises a track 101, a circuit board 102, a first electrical connector 103, and a second electrical connector 104 (refer to FIG. 6). The track 101 comprises a fixing base 1011, a first convex part 1015, and a second convex part 1016. The fixing base 1011 has a bottom part 1012, a first sidewall 1013, and a second sidewall 1014 opposing to the first sidewall 1013. The first and second sidewalls 1013, 1014 are disposed at and perpendicular to the bottom part 1012. The first convex part 1015 is disposed on the first sidewall 1013; the second convex part 1016 is disposed on the second sidewall 1014. The first and second convex parts 1015, 1016 extend vertically into the fixing base 1011, respectively. The second convex part 1016 corresponds to the first convex part 1015. In addition, the fixing base 1011 of the track 101 has a gap 1017 on each of the both ends, respectively, for accommodating the electronic device 2.

Figure 4:
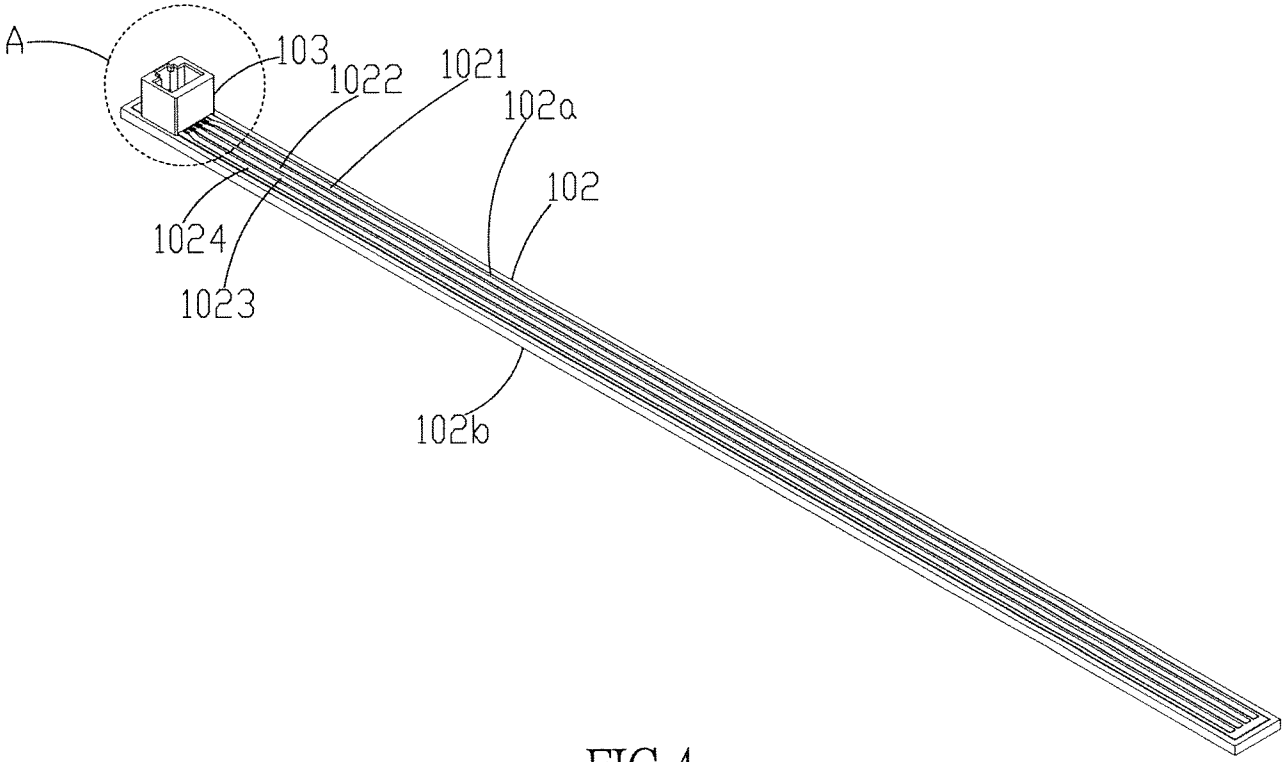
FIG. 4 shows a schematic diagram of the circuit board according to the first embodiment of the present disclosure.
Figure 5:
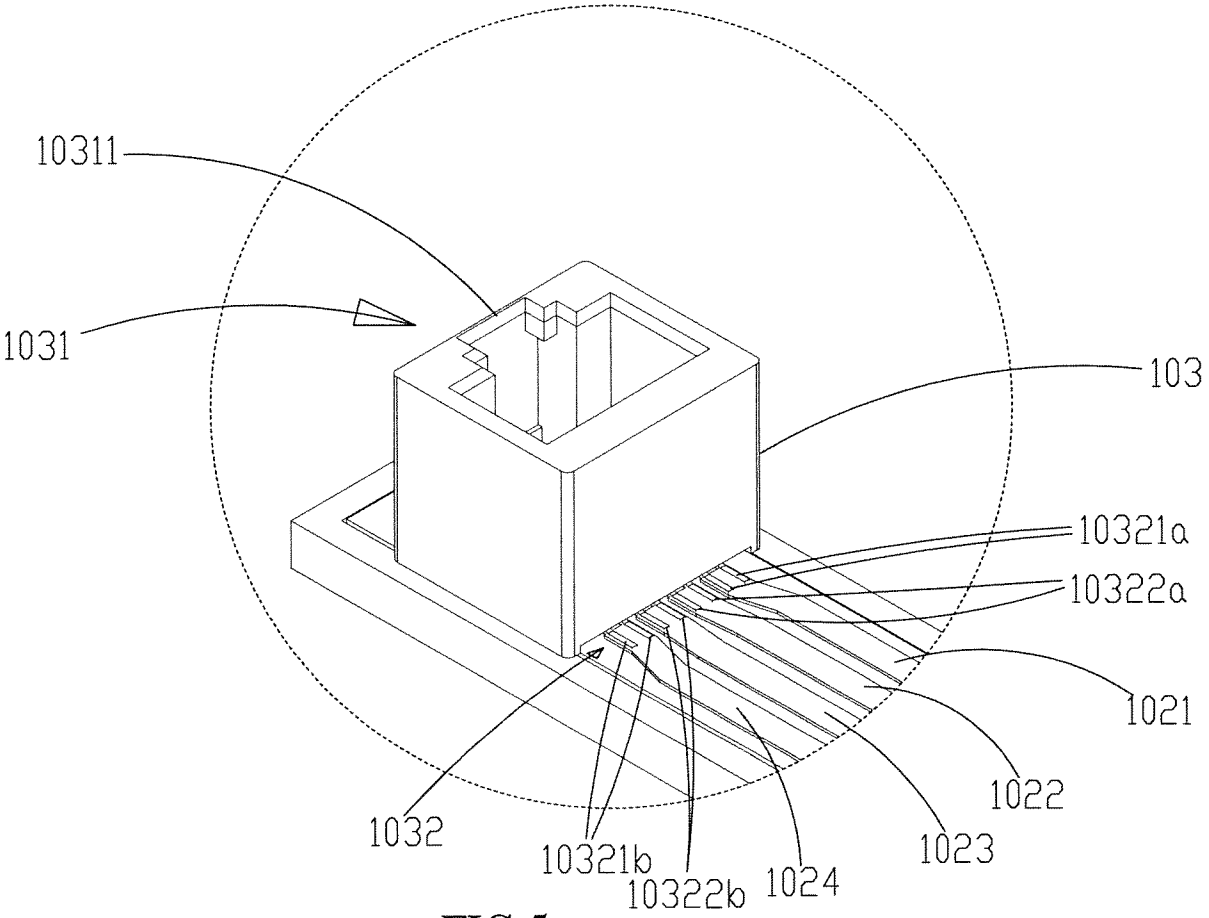
FIG. 5 shows an enlarged view of the region A in FIG. 4 according to the present disclosure.

FIG. 4 shows a schematic diagram of the circuit board according to the first embodiment of the present disclosure. As shown in the figure, the circuit board 102 has a first surface 102*a* and an opposing second surface 102*b*. A plurality of transmission circuits are printed on the first surface 102*a* and including a power transmission circuit 1021, a signal input circuit 1022, a signal output circuit 1023, and a ground circuit 1024. The power transmission circuit 1021, the signal input circuit 1022, the signal output circuit 1023, and the ground circuit 1024 are parallel with each other. FIG. 5 shows an enlarged view of the region A in FIG. 4 according to the present disclosure. As shown in the figure the first electrical connector 103 is disposed at one of the two ends of the circuit board 102. The first electrical connector 103 has a first connecting terminal 1031 and a second connecting terminal 1032. The first connecting terminal 1031 has a first connecting port 10311; the second connecting terminal 1032 includes a plurality of first terminals. The plurality of first terminals include at least a first power terminal 10321*a*, at least a first ground terminal 10321*b*, at least a first signal input terminal 10322*a*, and at least a first signal output terminal 10322*b*. The first power terminal 10321*a* and the first ground terminal 10321*b* are coupled to the power transmission circuit 1021 and the ground circuit 1024, respectively; the first signal input terminal 10322*a* and the first signal output terminal 10322*b* are coupled to the signal input circuit 1022 and the signal output circuit 1023, respectively.

Figure 7:
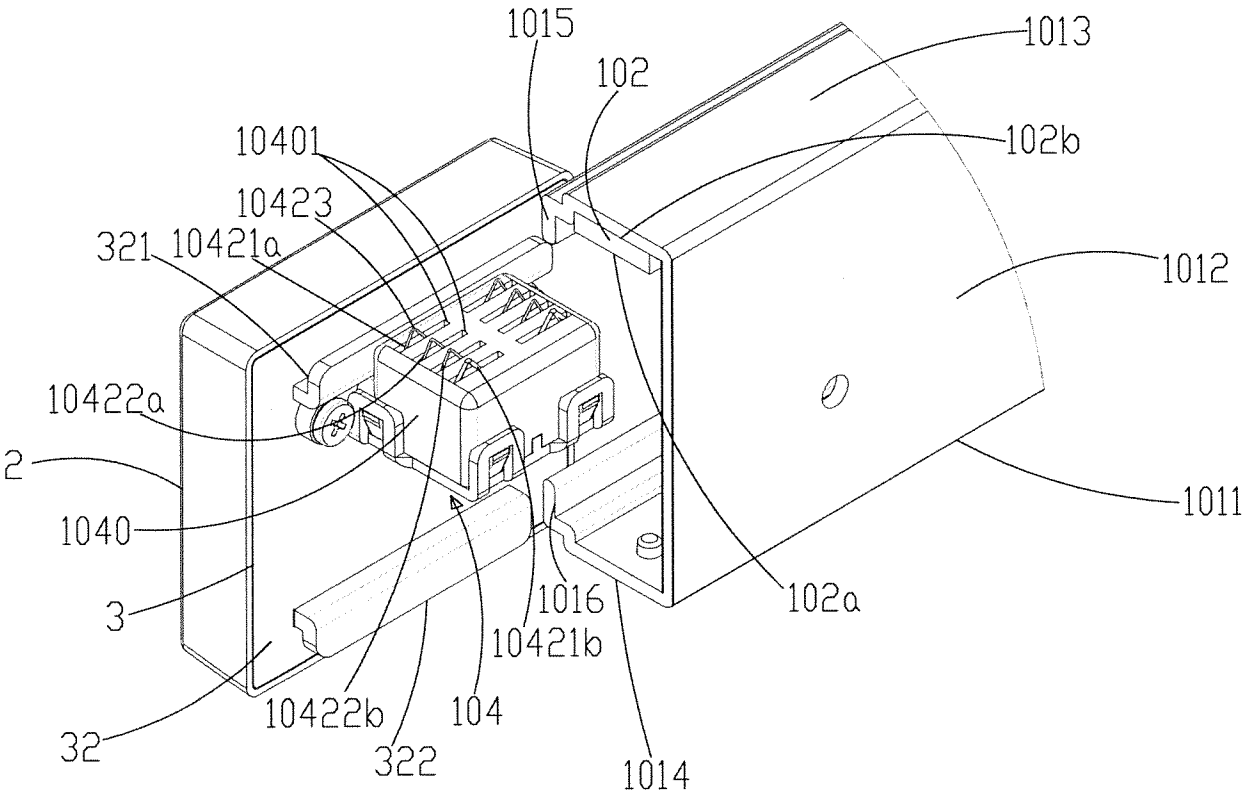
FIG. 7 shows an enlarged view of the region B in FIG. 6 according to the first embodiment of the present disclosure.

After the first electrical connector 103 is disposed on the circuit board 102, the circuit board 102 is disposed on the first sidewall 1013 of the track 101 and located between the first convex part 1015 and the bottom part 1012. According to the present embodiment, the second surface 102*b* of the circuit 102 has a glue member for attaching to the first sidewall 1013, as shown in FIG. 7. In addition, the first surface 102*a* printed with the plurality of transmission circuits faces the second sidewall 1014. The first connector 103 is adjacent to one of the two gaps 1017 of the track 101. Of course, the circuit board 102 can also be disposed on the second sidewall 1014 of the track 101. The details will not be described further.

Figure 6:
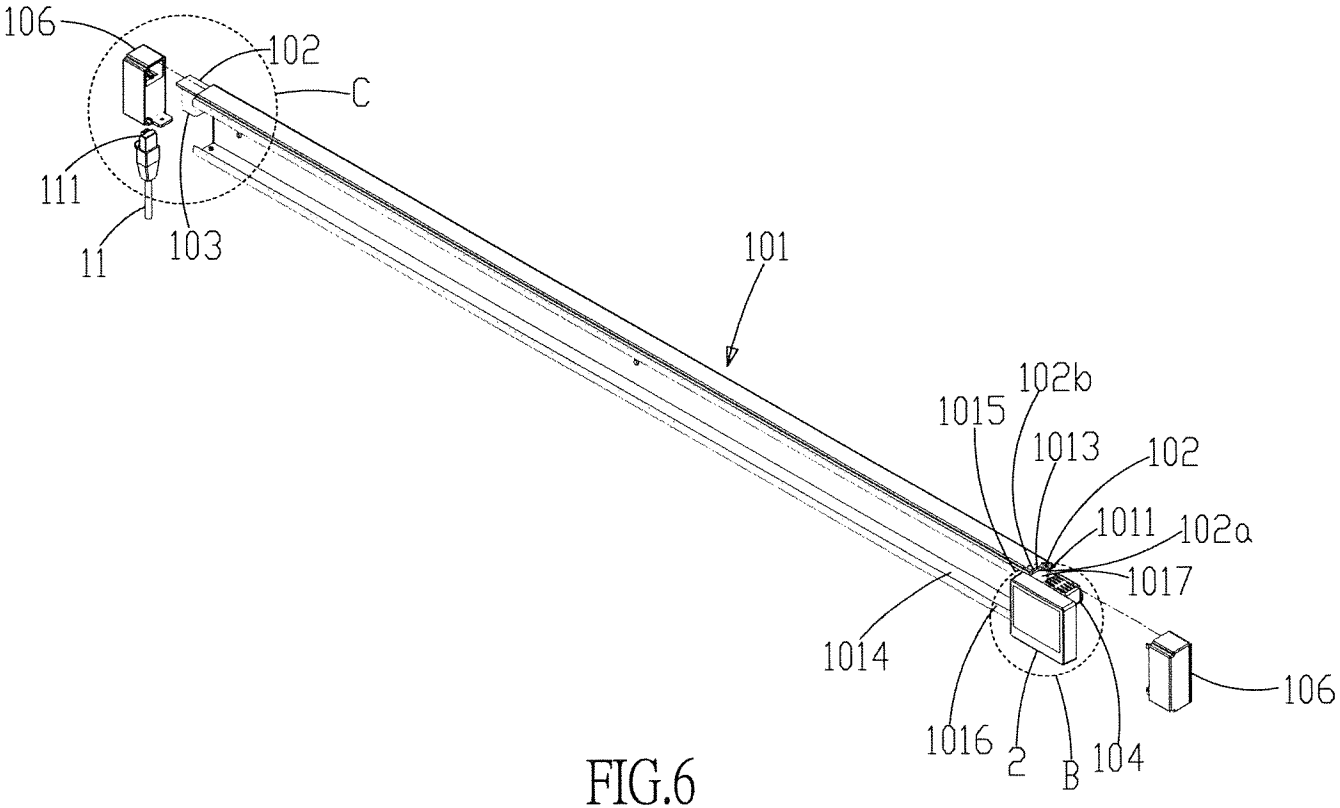
FIG. 6 shows another assembly diagram of the track transmission device according to the first embodiment of the present disclosure.
Figure 8:
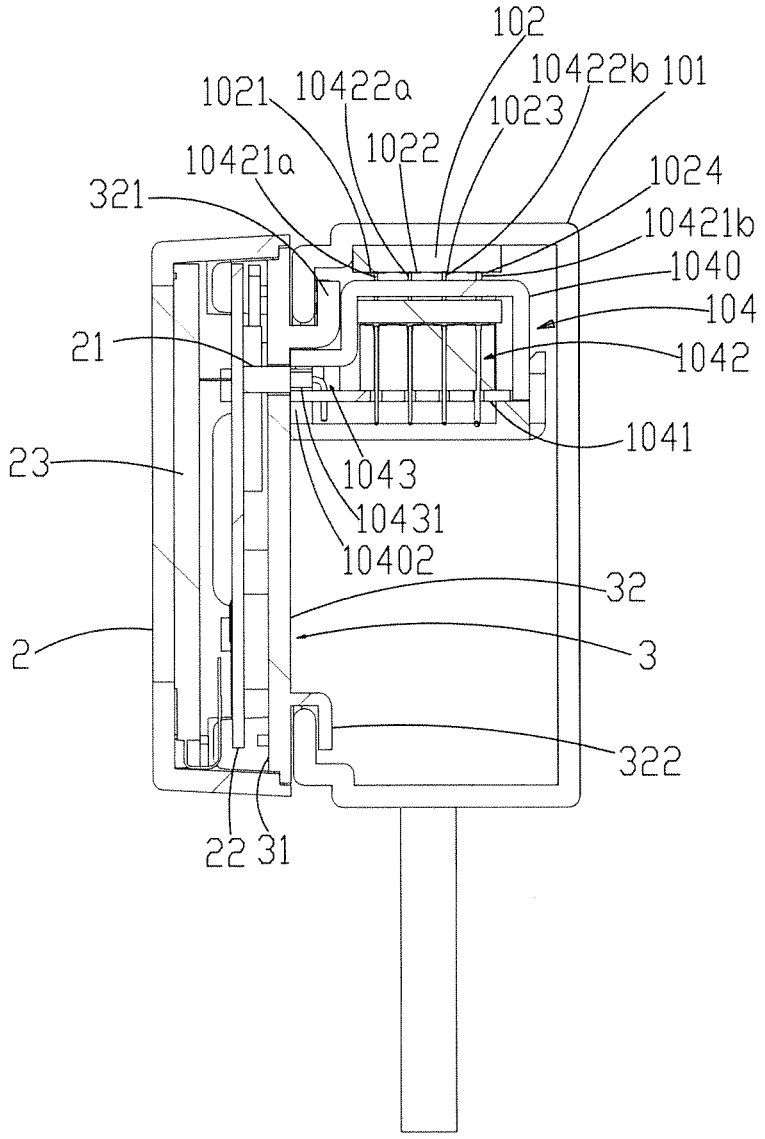
FIG. 8 shows a cross-sectional view of the track transmission device according to the first embodiment of the present disclosure.

FIG. 6 shows another assembly diagram of the track transmission device; FIG. 7 shows an enlarged view of the region B in FIG. 6; and FIG. 8 shows a cross-sectional view of the track transmission device according to the first embodiment of the present disclosure. As shown in the figure, the second electrical connector 104 is used for connecting electrically the electronic device 2 with the circuit board 102 in the track 101. The second electrical connector 104 has a housing 1040 and a conversion circuit board 1041. The conversion circuit board 1041 is disposed in the housing 1040 and has a first transmission terminal 1042 and a second transmission terminal 1043. The first transmission terminal 1042 has a plurality of second terminals. The plurality of second terminals include at least a second power terminal 10421*a*, at least a second ground terminal 10421*b*, at least a second signal input terminal 10422*a*, and at least a second signal output terminal 10422*b*. The second transmission terminal 1043 also has a second connecting port 10431. The second power terminal 10421*a*, the second ground terminal 10421*b*, the second signal input terminal 10422*a*, the second signal output terminal 10422*b*, and the second connecting port 10431 are all coupled to the circuit board 1041. The housing 1040 has a plurality of first openings 10401 and second opening 10402. The second power terminal 10421*a*, the second ground terminal 10421*b*, the second signal input terminal 10422*a*, and the second signal output terminal 10422*b* are located in the plurality of first openings 10401, respectively, and extend outside the housing 1040 from the plurality of first openings 10401. Moreover, the second connecting port 10431 is located in the second opening 10402 and extends outside the housing 1040 from the second opening 10402.

Before the electronic device 2 is disposed slidably on the track 101, the electronic device 2 is first disposed on a carrying base 3. The carrying base 3 has a carrying surface 31 and a fixing surface 32 opposing to the carrying surface 31. The electronic device 2 is disposed on the carrying surface 31. Next, the second electrical connector is coupled to the electronic device 2. The second connecting port 10431 of the second electrical connector 104 plugs into a third connecting port 21 of the electronic device 2. The third connecting port 21 is coupled to a microprocessor 22 inside the electronic device 2. Meanwhile, the second electrical connector 104 is fixed to the fixing surface 32 of the carrying base 3. In addition, the fixing surface 32 of the carrying base 3 further has a first hook 321 and a second hook 322 corresponding to each other. When the carrying base having the electronic device 2 is installed on the track 101, the carrying base 3 enters the track 101 from the gap 1017 without the first electrical connector 103. The first and second hooks 321, 322 of the carrying base 3 hook the first and second convex parts 1015, 1016, respectively. The carrying base 3 slides along the track 101 and thus enabling the electronic device 2 to slide along the track 101.

As the electronic device 2 is disposed on the track 101, the second power terminal 10421*a* and the second ground terminal 10421*b* coupled to the second electrical connector 104 of the electronic device 2 contact the power transmission circuit 1021 and the ground circuit 1024 of the circuit board 102 disposed on the track 101, respectively; the second signal input terminal 10422*a* and the second signal output terminal 10422*b* contact the signal input circuit 1022 and the signal output circuit 1023 of the circuit board 102, respectively. When the carrying base 3 having the electronic device 2 slides along the track 101, the plurality of second terminals of the second electrical connector 104 keep contacting the plurality of transmission circuits of the circuit board 102. Thereby, the first power terminal 10321*a* and the first ground terminal 10321*b* of the first electrical connector 103, the power transmission circuit 1021 and the ground circuit 1024 of the circuit board 102, and the second power terminal 10421*a* and the second ground terminal 10421*b* of the second electrical connector 103 are coupled to each other for facilitating forming a power transmission path between the electronic device 2 and the connecting device 12. Besides, the first signal input terminal 10322*a* of the first electrical connector 103, the signal input circuit 1022 of the circuit board 102, and the second signal input terminal 10422*a* of the second electrical connector 104 are coupled to each other for facilitating forming a signal input path between the electronic device 2 and the connecting device 12. Likewise, the first signal output terminal 10322*b* of the first electrical connector 103, the signal output circuit 1023 of the circuit board 102, and the second signal output terminal 10422*b* of the second electrical connector 104 are coupled to each other for facilitating forming a signal output path between the electronic device 2 and the connecting device 12.

At this time, the connecting device 12 connects to the first electrical connector 103 of the track transmission device 10 via a transmission line 11. Namely, a fourth connecting port 111 of the transmission line 11 plugs into the first connecting port 10311 of the first electrical connector 103. The connecting device 12 supplies power. The power is transmitted along the power transmission path to the electronic device 2 sliding on the track 101. Hence, the electronic device 2 acquires power for operations. As the electronic device 2 acquires the power, the microprocessor 22 inside the electronic device 2 can control various devices, for example, the display 23, in the electronic device 2. Meanwhile, the control device 14 connecting with the connecting device 12 transmits the control signal to the connecting device 12. The connecting device 12 transmits the control signal. The control signal is transmitted to the electronic device 2 along the signal input path. The microprocessor 22 of the electronic device 2 controls the operations of various devices according to the control signal. For example, a control signal of the microprocessor 22 controls the information content displayed on the display 23. The microprocessor 22 generates a signal, such as a feedback signal. The signal is transmitted to the connecting device 12 along the signal output path. Then the connecting device 12 transmits the signal to the control device 14. The control device 14 can thus generate the corresponding control signal according to the signal.

Furthermore, the electronic device 2 according to the present embodiment slides on the track 101. Once the plurality of second terminals of the second electrical connector 104 keep contacting the plurality of transmission circuits of the circuit board 102 disposed on the track 101, the conduction of the power transmission path, the signal input path, and the signal output path is maintained. It means that the electronic device 2 can receive the power supplied by the connecting device 12 through the power transmission path continuously; the electronic device 2 can receive the control signal transmitted by the control device 14 through the signal input path; and the electronic device 2 can transmit signals to the control device 14 via the signal output path. Thereby, the electronic device 2 can slide to the desired position according to the user's requirement. In addition, during the moving process, the operation is not interrupted and signals keep being transmitted between the electronic device 2 and the control device 14.

According to the present embodiment, the second power terminal 10421*a*, the second ground terminal 10421*b*, the second signal input terminal 10422*a*, and the second signal output terminal 10422*b* are protected by the housing 1040. Besides, the plurality of first openings 10401 separate the second power terminal 10421*a*, the second ground terminal 10421*b*, the second signal input terminal 10422*a*, and the second signal output terminal 10422*b*. Consequently, the situation of the second power terminal 10421*a*, the second ground terminal 10421*b*, the second signal input terminal 10422*a*, and the second signal output terminal 10422*b* being aslant and not corresponding to the correct circuits due to hits of external force can be avoided. In addition, if the second power terminal 10421*a*, the second ground terminal 10421*b*, the second signal input terminal 10422*a*, and the second signal output terminal 10422*b* contact each other due to hits of external force, the conduction of the power transmission path, the signal input path, and the signal output path cannot be maintained. Thereby, the connecting device 12 cannot supply power or transmit signals to the electronic device 2, or the electronic device 2 cannot transmit the control signal to the connecting device 12. The second signal input terminal 10422*a* and the second signal output terminal 10422*b* according to the present embodiment are located between the second power terminal 10421*a* and the second ground terminal 10421*b*. The plurality of transmission circuits and the plurality of first terminals of the first electrical connector 103 are arranged according to the plurality of second terminals. Thereby, the short-circuit state caused by excessive proximity of the second power terminal 10421*a* and the second ground terminal 10421*b* can be prevented. Once it happens, the connecting device 12 will not be able to supply power to the electronic device 2.

Refer again to FIG. 7. According to the present embodiment, the second power terminal 10421*a*, the second ground terminal 10421*b*, the second signal input terminal 10422*a*, and the second signal output terminal 10422*b* are bent metal elastic sheets, respectively. In other words, the second power terminal 10421*a*, the second ground terminal 10421*b*, the second signal input terminal 10422*a*, and the second signal output terminal 10422*b* have a bending part 10423, respectively. Each bending part 10423 extends outside the housing 1040 from the corresponding first opening 10401. Then the plurality of bending parts 10423 contact the power transmission circuit 1021, the signal input circuit 1022, the signal output circuit 1023, and the ground circuit 1024, respectively, for reinforcing the contact between the second power terminal 10421*a*, the second ground terminal 10421*b*, the second signal input terminal 10422*a*, and the second signal output terminal 10422*b* and the plurality of transmission circuits of the circuit board 102.

Then, a new set of second power terminal 10421*a*, second ground terminal 10421*b*, second signal input terminal 10422*a*, and second signal output terminal 10422*b* is added. Namely, there are two second power terminals 10421*a*, two second ground terminals 10421*b*, two second signal input terminals 10422*a*, and two second signal output terminals 10422*b* contacting the plurality of transmission circuits. Thereby, once one of the two second power terminals 10421*a*, the two second ground terminals 10421*b*, the two second signal input terminals 10422*a*, and the two second signal output terminals 10422*b* is damaged, the conduction of the power transmission path, the signal input path, and the signal output path still can be maintained, so that the electronic device 2 can keep operating and transmitting signals with the control device 14. Accordingly, the stability of the contacts between plurality of second terminals and the plurality of transmission circuits is enhanced.

Figure 9:
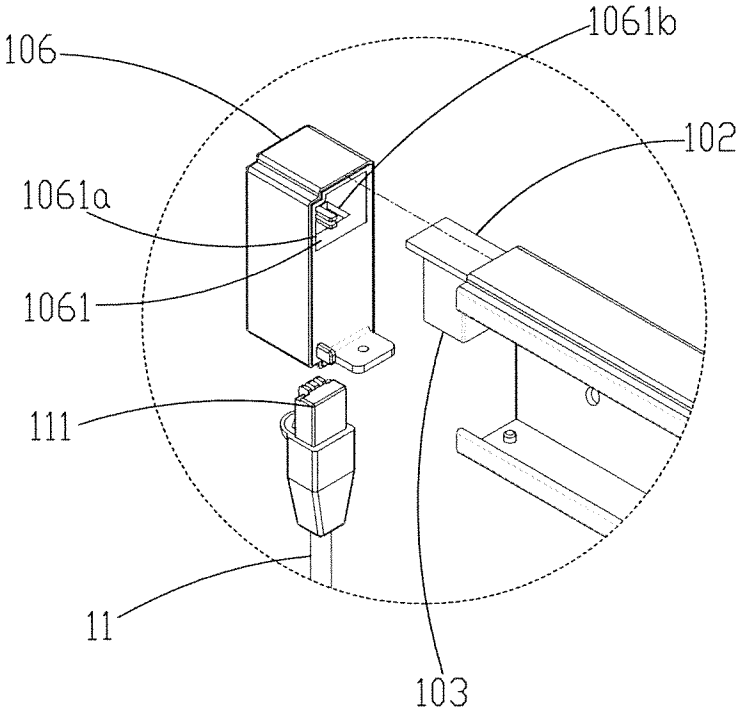
FIG. 9 shows an enlarged view of the region C in FIG. 6 according to the present disclosure.
Figure 10:
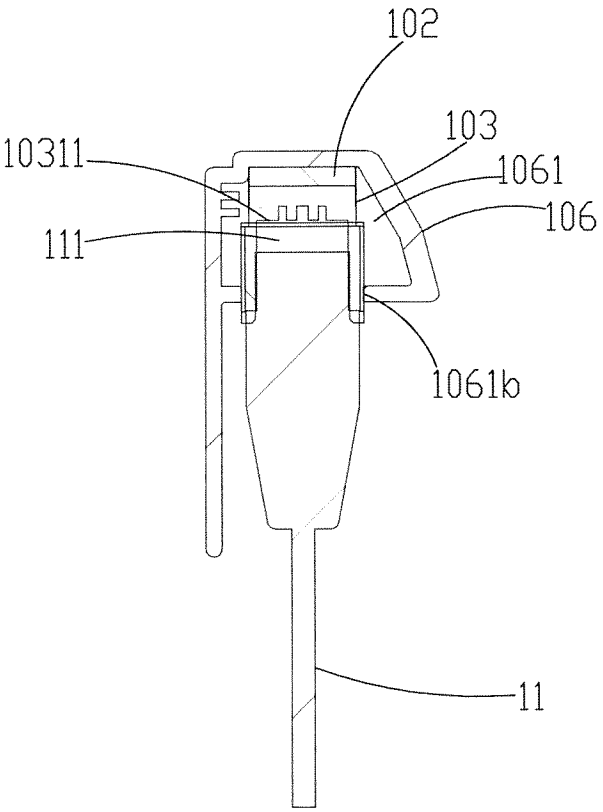
FIG. 10 shows a cross-sectional view of the side lid according to the first embodiment of the present disclosure.

Refer again to FIGS. 2 and 6 and refer to FIG. 9 and FIG. 10. The track transmission device 10 according to the present embodiment further comprises two side lids 106 disposed at the two gaps 1017 of the track 101 for supporting the track 101 and avoiding deformation of the first and second sidewalls 1013, 1014 of the track 101 due to the weight of the electronic device 2. The side lid 106 disposed at the gap 1017 having the first electrical connector 103 comprises an accommodating part 1061, a first installation hole 1061*a*, and a second installation hole 1061*b*. The first and second installation holes 1061*a*, 1061*b* communicate with the accommodating part 1061. The first installation hole 1061*a* corresponds to the track 101, so that the first electrical connector 103 can enter the accommodating part 1061 of the side lid 106 from the first installation hole 1061*a*. The accommodating part 1061 accommodates the first electrical connector 103. The second installation hole 1061*b* corresponds to the first connecting port 10311 of the first electrical connector 103. Thereby, the fourth connecting port 111 of the transmission line 11 plugs into the first connecting port 10311.

Figure 11:
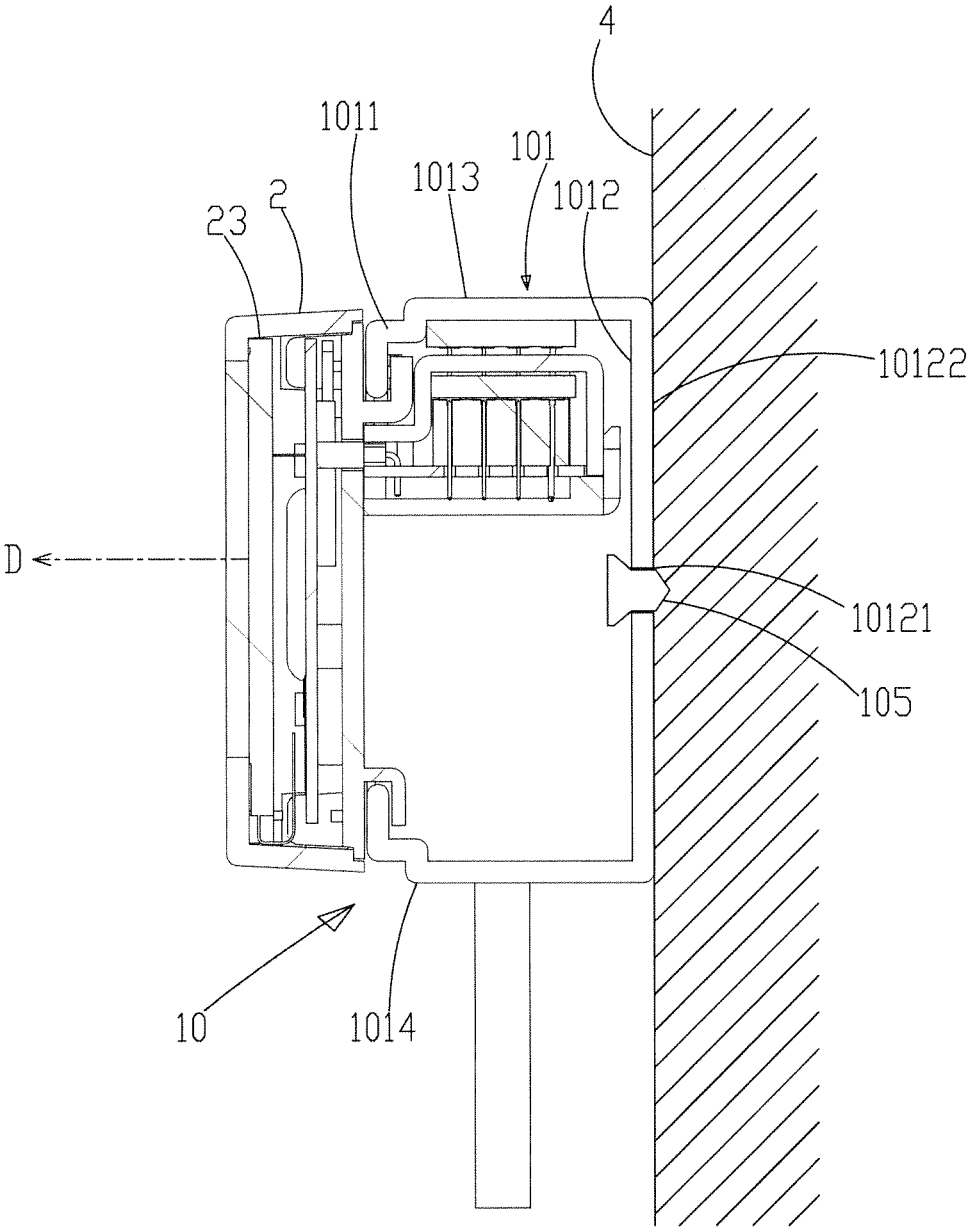
FIG. 11 shows a schematic diagram of the track transmission device disposed on a plane according to the first embodiment of the present disclosure.

FIG. 11 shows a schematic diagram of the track transmission device disposed on a plane according to the first embodiment of the present disclosure. As shown in the figure, the track transmission device 10 can be disposed on a plane 4 directly. The plane 4 can be the plane of a wall, the plane of an exhibition frame, or the plane of other objects. To dispose the track transmission device on the plane 4, the fixing base 1011 of the track 101 is fixing to the plane 4 by locking. The bottom part 1012 of the fixing base 1011 has a plurality of locking holes 10121. A plurality of locking members 105 pass through the corresponding locking holes 10121, respectively, and are locked on the plane 4 for fixing the fixing base 1011 on the plane 4. According to the present embodiment, a fixing surface 10122 of the bottom part 1012 of the fixing base 1011 is perpendicular to the extension direction of the first and second sidewalls 1013, 1014. The fixing surface 10122 contacts the plane 4 planarly. The extension direction of the first and second sidewalls 1013, 1014 is also perpendicular to the plane 4. As the fixing surface 10122 of the fixing base 1011 is fixed on the plane 4, the electronic device 2 disposed on the track 2 is perpendicular to the extension direction of the first and second sidewalls 1013, 1014. Besides, the displaying direction D of the display 23 on the electronic device 2 is perpendicular to the plane 4.

Figure 12:
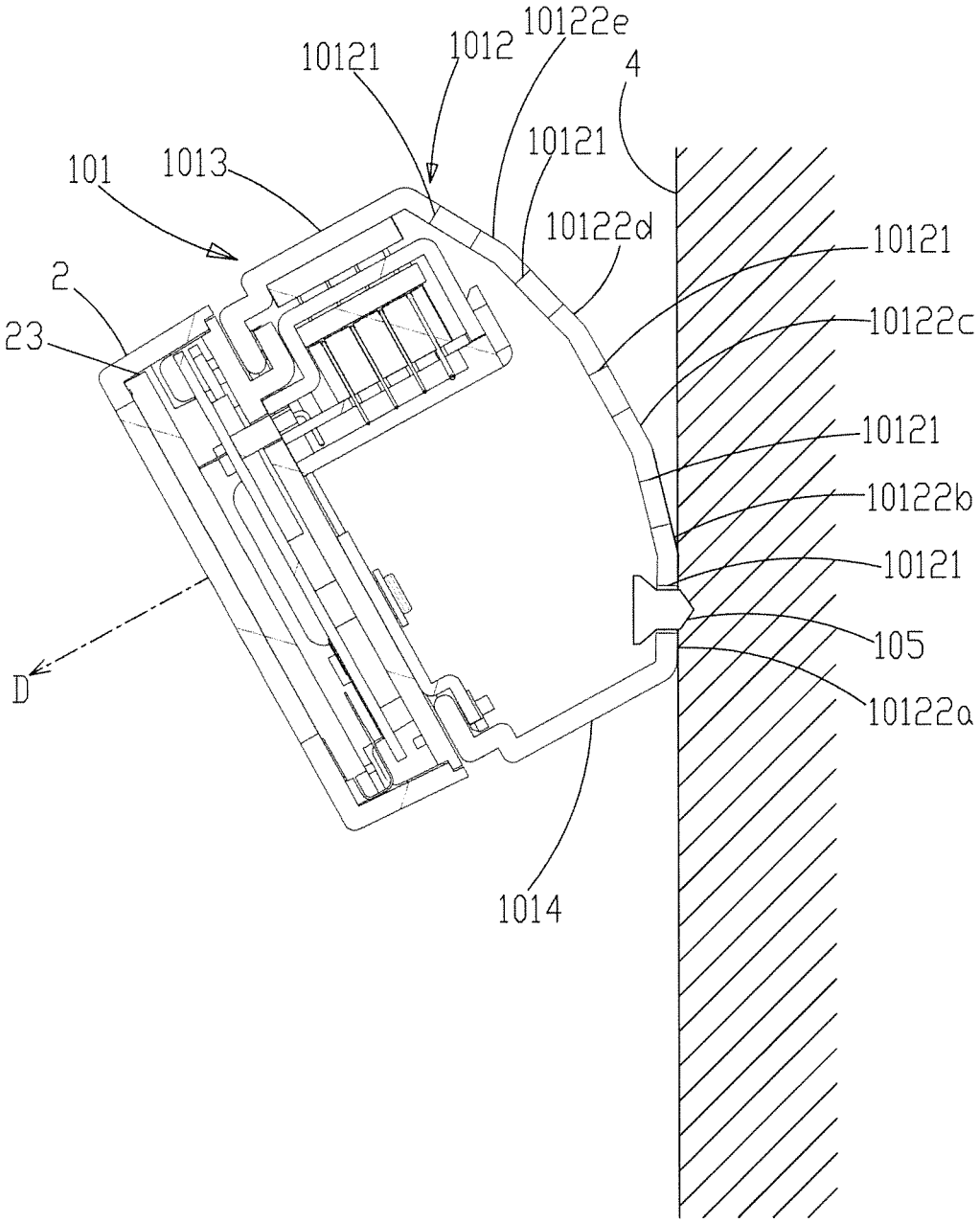
FIG. 12 shows a schematic diagram of the track transmission device disposed on a plane according to the second embodiment of the present disclosure.

FIG. 12 shows a schematic diagram of the track transmission device disposed on a plane according to the second embodiment of the present disclosure. As shown in the figure, the bottom part 1012 according to the present embodiment comprises a first fixing surface 10122*a*, a second fixing surface 10122*b*, a third fixing surface 10122*c*, a fourth fixing surface 10122*d*, and a fifth fixing surface 10122*e*. The third fixing surface 10122*c* is perpendicular to the extension direction of the first and second sidewalls 1013, 1014. There is a tilt angle between the first fixing surface 10122*a*, the second fixing surface 10122*b*, the third fixing surface 10122*c*, the fifth fixing surface 10122*e* and the extension direction of the first and second sidewalls 1013, 1014, respectively. The situation when the user selects the third fixing surface 10122*c* for disposing on the plane 4 is identical to the embodiment shown in FIG. 11. Hence, the details will not be described again. If the user selects any of the first fixing surface 10122*a*, the second fixing surface 10122*b*, the third fixing surface 10122*c*, and the fifth fixing surface 10122*e*, the angle between the extension direction of the first and second sidewalls 1013, 1014 and the plane 4 changes according to the tilt angle between any of the first fixing surface 10122*a*, the second fixing surface 10122*b*, the third fixing surface 10122*c*, the fifth fixing surface 10122*e* and the extension direction of the first and second sidewalls 1013, 1014. Besides, the display direction D of the electronic device changes according to the angle between the extension direction of the first and second sidewalls 1013, 1014 and the plane 4.

For example, if the user selects the first fixing surface 10122*a* to be fixed to the plane 4, the extension direction of the first and second sidewalls 1013, 1014 faces obliquely downward; if the user selects the fourth fixing surface 10122*d* to be fixed to the plane 4, the extension direction of the first and second sidewalls 1013, 1014 faces obliquely upward. Of course, the first fixing surface 10122*a*, the second fixing surface 10122*b*, the third fixing surface 10122*c*, the fourth fixing surface 10122*d*, and the fifth fixing surface 10122*e* include the plurality of locking holes 10121, respectively, for locking the first fixing surface 10122*a*, the second fixing surface 10122*b*, the third fixing surface 10122*c*, the fourth fixing surface 10122*d*, and the fifth fixing surface 10122*e* to the plane 4.

Figure 13:
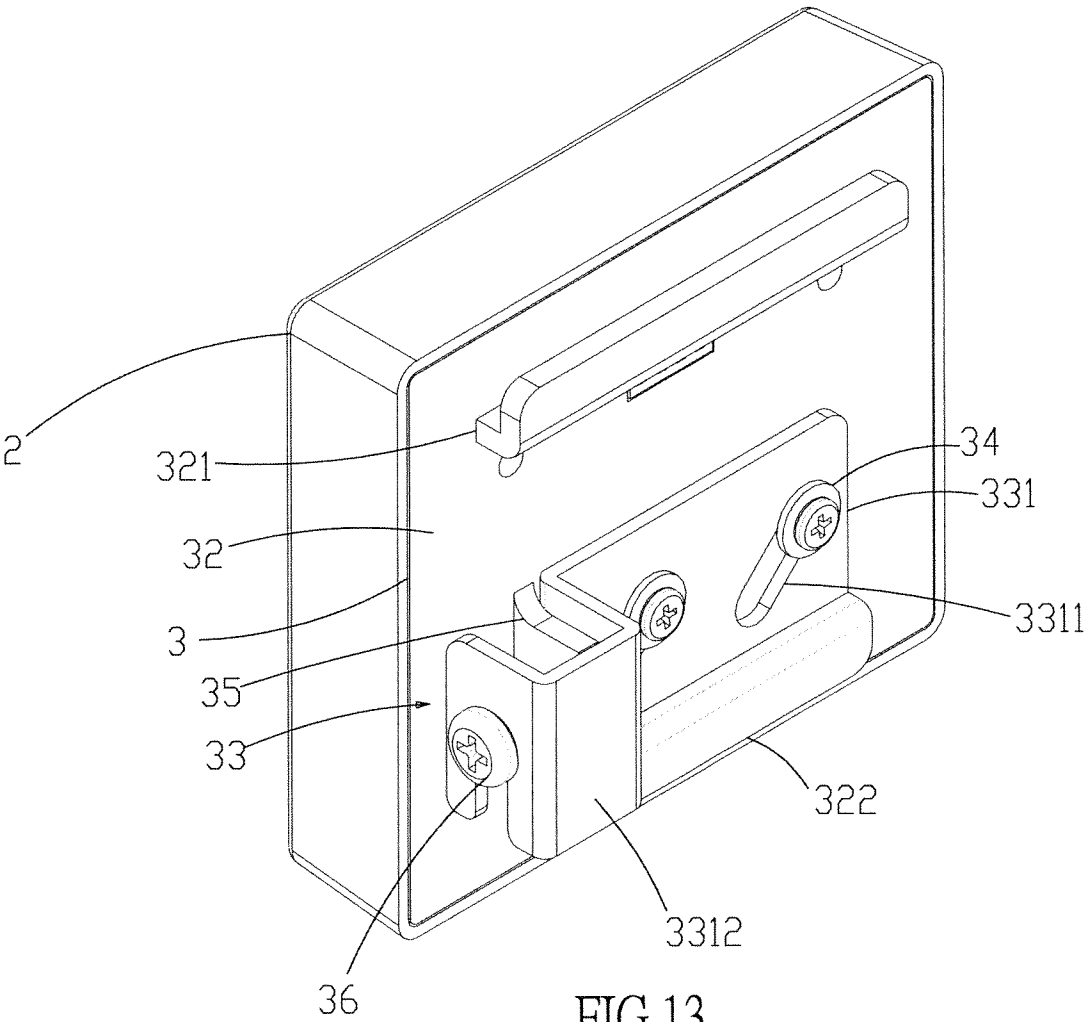
FIG. 13 shows a schematic diagram of the carrying base according to the third embodiment of the present disclosure.
Figure 14:
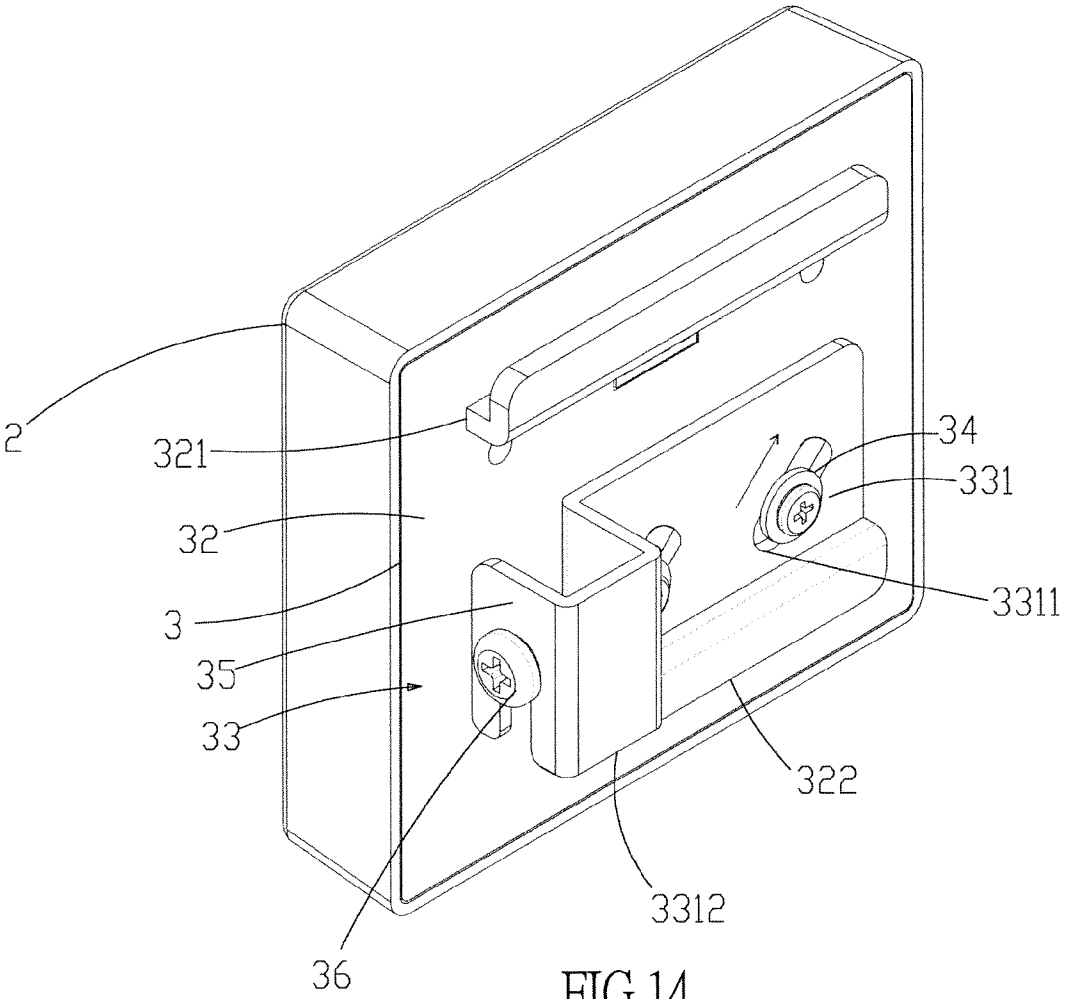
FIG. 14 shows a usage status diagram of the carrying base according to the third embodiment of the present disclosure.
Figure 15:
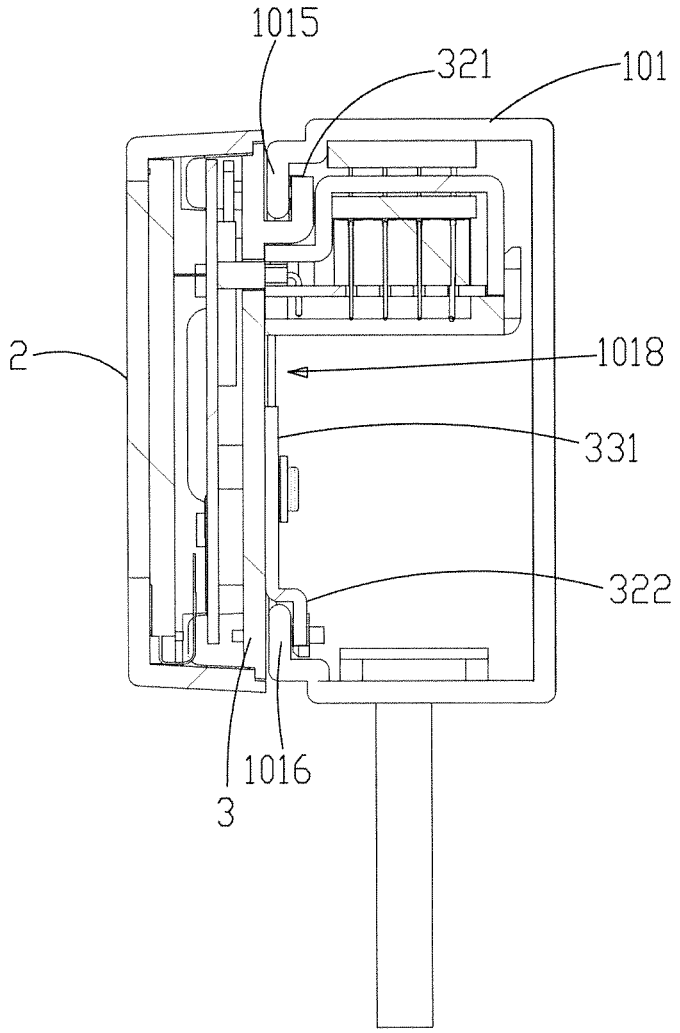
FIG. 15 shows a cross-sectional view of the carrying base disposed on the track according to the third embodiment of the present disclosure.

FIGS. 13 to 15 show a schematic diagram and a cross-sectional view of the carrying base and a cross-sectional view of the carrying base disposed on the track, respectively, according to the third embodiment of the present disclosure. As shown in the figures, when the carrying base 3 with the electronic device 2 according to the embodiment described above is to be disposed on the track 101, it needs to enter from the gap without the first electrical connector 103. On the contrary, the carrying base 3 according to the present embodiment needs not to enter from the gap. Instead, it can enter directly from the opening 1018 between the first and second convex parts 1015, 1016. Thereby, it is required to disassemble the two side lids 106 placed on the two gaps. For achieving the effect described above, the second hook 322 has to be movable. As the carrying base 3 is to be disposed on the track 101, the second hook 322 is first moved to make the second hook 322 not contacting the second convex part 1016 of the track 101. Then the carrying base 3 can enter the track 101. Next, the first hook 321 of the carrying base 3 hooks the first convex part 1015 of the track 101. Afterwards, the second hook 322 is moved to hook the second convex part 1016. Thereby, the carrying base 3 is disposed slidably on the track 101.

To make the second hook 322 movable, the carrying base 3 further comprises a moving mechanism 33, which includes a moving base 331. One side of the moving base 331 is connected to the second hook 322. According to the present embodiment, the moving base 331 and the second hook 322 are formed integrally. The moving base 331 has at least a positioning groove 3311, which is provided for a positioning pillar 34 of the carrying base 3 to pass through. The moving base 3 has a fixing part 3312 at one end. The fixing part 3312 is disposed at a fixing member 35 of the carrying base 3. Then a locking member 36 is used for passing through the fixing part 3312 and the fixing member 35 for fixing the fixing part 3312 to the fixing member 35 of the carrying base 3. Thereby, the moving base 331 can be fixed to the carrying base 3.

Before disposing the carrying base 3 slidably to the track 101, it is necessary to move the second hook 322 toward the first hook 321 first. Thereby, the moving base 331 needs to drive the second hook 322 to move toward the first hook 321. Nonetheless, the moving base 331 is limited by the positioning groove 3311 and the positioning pillar 34. The moving base 331 only moves obliquely upwards. After the moving base 331 has moved upwards, the locking member 36 locks the moving base 331 to the carrying base 3.

Next, place the carrying base 3 from the opening 1018 between the first and second convex parts 1015, 1016. Then the first hook 321 is made to hook the first convex part 1015. Meanwhile, release the locking member 36 to make the moving base 331 drive the second hook 322 to move obliquely downwards and hook the second convex part 1016. At last, use the locking member 36 to fix the moving base 331 to the carrying base 3 and thus disposing the carrying base 3 slidably on the track 101.

To sum up, the present disclosure provides a track transmission system and the track transmission device thereof. The track transmission device is provided for disposing slidably electronic device. The electronic device does not use transmission lines to transmit power and signals. Thereby, when the electronic device slide along the track transmission device, the operations will not be interrupted due to the obstruction of the transmission lines. Thereby, the electronic device can move to the desire position according to the user's requirement. In addition, during the moving process, the transmission of power and signals is maintained. The track transmission device can have multiple electronic devices at the same time. The track transmission device supplies power to the plurality of electronic devices simultaneously; the plurality of electronic devices can perform signal transmission with the remote single control device directly. Hence, the control device can control the operations of the plurality of electronic devices simultaneously and the displayed information on the plurality of electronic devices can be changed real-timely. Moreover, it is not required to dispose wireless modules on the electronic devices; signals can be transmitted via the track transmission device for reducing costs effectively.

Accordingly, the present disclosure conforms to the legal requirements owing to its novelty, nonobviousness, and utility. However, the foregoing description is only embodiments of the present disclosure, not used to limit the scope and range of the present disclosure. Those equivalent changes or modifications made according to the shape, structure, feature, or spirit described in the claims of the present disclosure are included in the appended claims of the present disclosure.

The invention claimed is:

1. A track transmission device, comprising:

a track, for disposing at least an electronic device, and said electronic device sliding along said track;

a circuit board, disposed on said track, and having a plurality of transmission circuits;

a first electrical connector, having a plurality of first terminals, and said plurality of first terminals coupled to said plurality of transmission circuits, respectively; and a second electrical connector, connected electrically with said electronic device, having a plurality of second terminals, and said plurality of second terminals coupled to said plurality of transmission circuits for transmitting signals and power to said electronic device.

2. The track transmission device of claim 1, and further comprising at least a carrying base, carrying said electronic device, and sliding along said track.

3. The track transmission device of claim 2, wherein said track comprises:

a fixing base, having a bottom part, a first sidewall, and a second sidewall, and said first sidewall corresponding to said second sidewall;

a first convex part, disposed on said first sidewall; and a second convex part, disposed on said second sidewall, and opposing to said first convex part;

where said carrying base further comprises a first hook and a second hook opposing said first hook, and said first hook and said second hook hook said first convex part and said second convex part, respectively.

4. The track transmission device of claim 3, and further comprising a moving mechanism, disposed on said carrying base, and driving said second hook to move.

5. The track transmission device of claim 4, wherein said moving mechanism comprises a moving base, connected to said second hook, having at least a positioning groove and a fixing part, said positioning groove putting around a positioning pillar of said carrying base, and said fixing part disposed at a fixing member of said carrying base.

6. The track transmission device of claim 3, wherein said bottom part of said fixing base has a plurality of locking holes provided for a plurality of locking members to pass through for fixing said fixing base to a plane.

7. The track transmission device of claim 3, wherein said bottom part of said fixing base includes a plurality of fixing surfaces; tilt angles between said plurality of fixing surfaces and an extension direction of said first sidewall and said second sidewall are different; said fixing base is fixed on a plane; and one of said plurality of fixing surfaces contacts planarly said plane for adjusting an angle between the extension direction of said first sidewall and said second sidewall and said plane.

8. The track transmission device of claim 7, wherein said plurality of fixing surfaces have a plurality of locking holes, respectively, for a plurality of locking members to pass through for fixing said fixing base to said plane.

9. The track transmission device of claim 3, wherein said fixing base has two gaps at both ends and said first electrical connector is located at one of said two gaps.

10. The track transmission device of claim 9, and further comprising two side lids, disposed at said two gaps, and accommodating said first electrical connector.

11. The track transmission device of claim 10, wherein at least one said side lid accommodating said first electrical connector comprises an accommodating part, a first installation hole, and a second installation hole; said first installation hole and said second installation hole communicates with said accommodating part; said first installation is used for placing said first electrical connector; and said second installation hole corresponds to a first connecting port of said first electrical connector.

12. The track transmission device of claim 1, wherein said plurality of first terminals comprise at least a first power terminal, at least a first ground terminal, at least a first signal input terminal, and at least a first signal output terminal; said plurality of transmission circuits comprises a power transmission circuit, a signal input circuit, a signal output circuit, and a ground circuit; said first power terminal and said first ground terminal are coupled to said power transmission circuit and said ground circuit, respectively; and said first signal input terminal and said first signal output terminal are coupled to said signal input circuit and said signal output circuit, respectively.

13. The track transmission device of claim 12, wherein said plurality of second terminals comprises at least a second power terminal, at least a second ground terminal, at least a second signal input terminal, and at least a second signal output terminal; said second power terminal and said second ground terminal are coupled to said power transmission circuit and said ground circuit, respectively; and said second signal input terminal and said second signal output terminal are coupled to said signal input circuit and said signal output circuit, respectively.

14. The track transmission device of claim 13, wherein said second electrical connector comprises a housing; said housing comprises a plurality of first openings; and said plurality of first openings accommodate said plurality of second terminals for separating said plurality of second terminals.

15. The track transmission device of claim 14, wherein said plurality of second terminals are bent metal elastic sheets having a bending part coupled to the corresponding transmission circuit, respectively.

16. The track transmission device of claim 14, wherein said housing further comprises a second opening corresponding to a second connecting port of said second electrical connector; and said second connecting port is connected electrically to a third connecting port of said electronic device.

17. A track transmission system, comprising:

at least a track transmission device, for disposing slidably at least an electronic device, respectively, and said electronic device connected electrically to said track transmission device;

a connecting device, connected electrically to said track transmission device, respectively; and a control device, connected to said connecting device, said control device and said track transmission device transmitting signals and power therebetween via said connecting device, and said track transmission device transmitting signals and power to said electronic device.

18. The track transmission system of claim 17, wherein said connecting device has a first transmission unit; said control device has a second transmission unit; said first transmission unit and said second transmission unit transmit and receive signals for transmitting signals to said electronic device and said control device.

19. The track transmission system of claim 17, wherein said track transmission device comprises:

a track, for disposing said electronic device, and said electronic device sliding along said track;

a circuit board, disposed on said track, and having a plurality of transmission circuits;

a first electrical connector, having a plurality of first terminals, and said plurality of first terminals coupled to said plurality of transmission circuits, respectively; and a second electrical connector, connected electrically with said electronic device, having a plurality of second terminals, and said plurality of second terminals coupled to said plurality of transmission circuits for transmitting signals and power to said electronic device.

* * * * *